US006192535B1

(12) United States Patent
Warner, Jr. et al.

(10) Patent No.: US 6,192,535 B1
(45) Date of Patent: Feb. 27, 2001

(54) STORAGE UNIT AND CANOPY FOR A FOLDING PLAY YARD WITH A BASSINET

(75) Inventors: Robert J. Warner, Jr., Akron; Leland M. Faa, Malvern, both of OH (US)

(73) Assignee: Graco Children's Products Inc., Elverson, PA (US)

( * ) Notice: Subject to any disclaimer, the term of this patent is extended or adjusted under 35 U.S.C. 154(b) by 0 days.

(21) Appl. No.: 09/420,804

(22) Filed: Oct. 19, 1999

Related U.S. Application Data

(60) Provisional application No. 60/136,132, filed on May 25, 1999.

(51) Int. Cl.[7] ..... A47D 7/04; A47D 13/00

(52) U.S. Cl. ..... 5/93.1; 5/93.2; 5/97; 5/99.1; 5/416; 135/96

(58) Field of Search ..... 5/93.1, 93.2, 97, 5/98.1, 98.3, 99.1, 95, 414, 416; 135/96

(56) References Cited

U.S. PATENT DOCUMENTS

| | | | | |
|---|---|---|---|---|
| 869,061 | | 10/1907 | Cox . | |
| 1,412,935 | | 4/1922 | Greenebaum . | |
| 1,839,580 | | 1/1932 | Myron . | |
| 1,845,814 | | 2/1932 | Reis et al. . | |
| 2,433,504 | | 12/1947 | Zimmermann . | |
| 3,487,479 | | 1/1970 | Grooms | 5/93 |
| 3,799,606 | | 3/1974 | Gesslein | 296/28 |
| 4,790,340 | * | 12/1988 | Mahoney | 5/414 X |
| 4,796,314 | | 1/1989 | Garduno | 5/98 |
| 4,846,204 | | 7/1989 | Sok Kyu | 135/106 |
| 4,945,584 | | 8/1990 | LaMantia | 5/97 |
| 5,161,269 | | 11/1992 | McLean et al. | 5/414 |
| 5,163,191 | | 11/1992 | Chan | 5/98.1 |
| 5,339,470 | | 8/1994 | Shamie | 5/98.1 |
| 5,341,530 | | 8/1994 | Ward | 5/93.1 |
| 5,553,336 | | 9/1996 | Mariol | 5/93.1 |
| 5,615,427 | | 4/1997 | Huang | 5/99.1 |
| 5,778,465 | | 7/1998 | Myers | 5/99.1 |
| 5,813,064 | | 9/1998 | Hartenstine | 5/99.1 |
| 5,862,548 | | 1/1999 | Gerhart | 5/93.1 |
| 5,867,850 | * | 2/1999 | Mariol | 5/93.2 |
| 5,918,329 | * | 7/1999 | Huang | 5/97 X |
| 5,991,944 | * | 11/1999 | Yang | 5/99.1 |

FOREIGN PATENT DOCUMENTS

| | | |
|---|---|---|
| 935821 | 7/1948 | (FR) . |
| 188935 | 3/1922 | (GB) . |
| 2 161 070 | 1/1988 | (GB) . |

OTHER PUBLICATIONS

Century Playard with Bassinet/Changer Instruction Manual, "Fold-$^{n}$-Go™Care Center" (Jan. 1998).

* cited by examiner

*Primary Examiner*—Michael F. Trettel
(74) *Attorney, Agent, or Firm*—Foley & Lardner

(57) ABSTRACT

Accessories for a foldable play yard apparatus, and more particularly to a play yard apparatus supporting a bassinet, include a storage unit and a canopy. The storage unit is adapted to be supported by the play yard apparatus adjacent to the bassinet and to provide a plurality of compartments suitable for organizing and readily presenting childcare items such as diapers, linens, and toys. The canopy is for the bassinet and includes a system of fasteners adapted to engage mating features on the bassinet.

16 Claims, 15 Drawing Sheets

STORAGE UNIT AND CANOPY FOR A FOLDING PLAY YARD WITH A BASSINET

This application claims the benefit of U.S. Provisional Application Ser. No. 60/136,132, filed May 25, 1999, which is incorporated by reference in its entirety.

BACKGROUND OF THE INVENTION

This invention generally relates to a foldable play yard apparatus, and more particularly to an improved play yard that may be converted to accomplish other baby caregiving functions. One exemplary play yard apparatus in the prior art is described in U.S. Pat. No. 5,381,570 to Cheng, which is incorporated herein by reference.

Folding play yards are well known in the prior art and comprise a standard item in parenting and baby caregiving. A conventional play yard enables a baby or toddler to play within a controlled and protected space without requiring continual attention by a responsible adult. Such conventional play yards can be folded into a small space for easy storage and transport and are therefore convenient items for use in high mobility situations.

However, conventional play yards do not address other baby caregiving functions, such as the need to provide adequate nap space for the child and the continual need for ready accessibility to diaper changing supplies, toys, clothing, linens, and other items associated with caring for an infant. Nor do conventional play yards address shielding the infant from sunlight, rain, wind, insects, and other undesirable aspects of the environment in which the play yard is likely to be used. As a result, parents or caretakers in mobility situations must transport other portable baby furniture, or must improvise these functions with whatever furniture is found at hand. For example, the shielding function may be accomplished with an umbrella, a towel, or some other linen. However, such an improvisation is fraught with unknown and unseen perils for the child, such as exposure to collapses, suffocation, the inability to observe the infant, and an arrangement that simply is not effective in providing a shield.

The frequent naps which small children require are often taken on the floor of conventional play yards, which is not designed for comfort in such use. Moreover, many small children sleep best in a smaller, cozier space, which conventional play yards do not provide. Thus, it has also been envisioned to provide conventional play yards with a removable bassinet structure that is generally suspended over a portion of the upper opening of the play yard. Such a bassinet is more suitable for newborn and infant use, due to the fact that a smaller, cozier sleeping space is preferred for such young children. According to the present invention, a storage unit may be fitted in the remaining portion of the upper opening for providing ready access to various supplies and other items for childcare.

The choice for many traveling parents or caretakers often is to transport a portable play yard, a folding bed or the like for naps, and a diaper bag or the like for carrying diaper changing supplies, food, toys, clothes, etc. Unfortunately, because these separate items must be transportable, it is often the situation that at least one of these items is not readily available, or does not provide ready access to the desired childcare item. Clearly, there is a need in the prior art for meeting these disparate apparatus requirements in an integrated, more organized, and still transportable form.

SUMMARY OF THE INVENTION

An object of the present invention is to provide a storage unit for a play yard apparatus that it is also convertible to a baby bassinet. The storage unit provides a plurality of compartments whereby many of the items used to carry out the typical baby caregiving functions are arranged in an organized and readily accessible manner.

Another object of the present invention is to provide a canopy unit for shielding at least a portion of the baby bassinet for a play yard. The canopy readily attaches to the bassinet structure and provides reliable shielding for a baby in the bassinet.

A conventional play yard foldable frame structure generally includes an upper frame assembly comprised of two pair of parallel foldable rail assemblies which are supported by corner leg assemblies. The rail assemblies support the side panels of the play yard, while a lower frame assembly is secured to the leg assemblies to support the floor portion of the apparatus.

At each corner of the upper frame assembly there is typically provided an upper corner bracket. Each of such upper corner brackets includes diverging body portions extending relatively orthogonally that are adapted to engage respective foldable rail assemblies. A web extends across the included angle between the diverging body portions, and a concave pocket is formed in the top surface of the web.

A typical bassinet assembly is removably supported on a portion of the upper frame assembly. Such a bassinet assembly includes a pair of bassinet frame assemblies that each include a pair of J-tube assemblies joined by a cross tube. The J-tube assemblies include outer ends that are adapted to overly the upper rail assemblies and be suspended therefrom. The bassinet floor panel is disposed below the upper rail assembly and above the floor of the play yard, and is supported on the cross tubes. Bassinet side panels and end panels of soft fabric extend upwardly from the bassinet floor panel to form a coffer-like enclosure that is sufficiently small and cozy for the resting and napping functions of a bassinet. Sleeves formed in the end panels and floor panel secure portions of the cross tubes and J-tube assemblies.

Regarding the pair of J-tube assemblies that comprise each bassinet frame assembly, a first outer J end overlies a respective upper corner bracket. A second outer J end is secured in a hub adapter that supports the second J end of the bassinet tube. The hub adapter is configured to rest on and be supported by a foldable joint assembly located generally at the midpoint of a respective upper rail assembly of the play yard frame structure. Thus the bassinet assembly is supported entirely by suspension from the upper frame portion of the play yard, and may be installed and removed as a single unit. The bassinet assembly is also readily disassembled and folded for easy transport. The particular construction of these conventional play yard and bassinet assemblies does not form part of the invention, except for their relationship to the components described hereinafter.

According to the first preferred embodiment of the present invention, there is provided a storage unit that is removably supported on a play yard assembly. The storage unit includes a tubular frame comprising pairs of side tubes and end tubes, all of which are joined in a rectangular configuration. Two vertices of the rectangular storage unit frame are disposed adjacent to the hub adapters of a bassinet assembly. The storage unit frame includes a pair of first elbow connectors, each of which is disposed at a respective one of these vertices and adapted to join a side tube and an end tube in an orthogonal relationship. Each first elbow connector further includes a T-shaped key extending outwardly therefrom, and each hub adapter is provides with a key slot to receive the key of the adjacent first elbow connector, whereby the hub adapter of the bassinet assembly supports an adjacent vertex of the storage unit frame.

The storage unit frame further includes a pair of second elbow connectors, each disposed adjacent to one upper corner bracket of the play yard and adapted to join a side tube and end tube of the storage unit frame in an orthogonal relationship. Each second elbow connector includes a pair of oppositely projecting lugs that extend along an axis that is generally transverse to the storage unit frame. Each second elbow connector is disposed to engage the web of the adjacent upper corner bracket in a supported relationship, and the lugs are each configured to be received in the concave pocket of the web to locate and retain the storage unit frame with respect to the upper corners of the play yard frame assembly. Thus the storage unit frame is supported at two corners by the upper corner brackets of the play yard frame assembly and at the other two corners by the adjacent hub adapters of the bassinet assembly.

The storage unit further includes a generally horizontal base joined to fabric side panels and fabric end panels, which in turn are provided with sleeves to engage the storage unit frame so as to be supported in a suspended relationship. The space defined within the horizontal base, side panels, and end panels is divided into at least two compartments by at least one pocket formed in conjunction with one of the side and end panels, or by at least one partition extending generally vertical with respect to the base, or by both.

Due to the fact that changing supplies and other childcare items are often used before and after napping, which takes place in the bassinet, the storage unit is placed in the most convenient possible location, i.e., in the remaining portion of the upper opening of the play yard adjacent to the bassinet. And, like the bassinet assembly, the storage unit may be removed as a unit from its supported position on the play yard, and may be readily folded or disassembled for easy transport. When both the bassinet assembly and storage unit assembly are removed, the upper opening of the play yard is unobstructed and the play yard is available for the purpose of permitting a baby or toddler to play within its controlled and protected interior space.

According to the second preferred embodiment of the present invention, there is provided a canopy assembly that is removably supported on the bassinet assembly. The canopy assembly includes a fabric panel including two buttonholes that slide over the J-tube assemblies at one end of the bassinet. A snap fastener is provided on either side of the exterior of the bassinet, and the canopy assembly includes cooperatively engaging snap fasteners. Attaching the canopy comprises sliding the buttonholes over the J-tube assemblies and snapping together the fasteners on the canopy and bassinet assemblies. At least one rod extends with respect to the fabric panel for supporting the fabric panel above the bassinet.

The above objects and advantages are realized according to the present invention by a storage unit for a folding play yard, the folding play yard having an upper frame assembly including two pairs of parallel foldable rail assemblies connected by upper corner brackets and a bassinet assembly being removably supported in a first portion of the upper frame assembly. The storage unit comprises a tubular frame having first and second side tubes and a pair of end tubes joined in a rectangular configuration, the tubular frame being adapted to be supported in a second portion of the upper frame assembly adjacent to the bassinet assembly; and a generally horizontal base joined to side panels and to end panels, each of the panels being provided with sleeves to engage a respective one of the tubes of the tubular fame so as to support the base in a suspended relationship. Wherein a space defined within the horizontal base, side panels, and end panels is divided into at least two compartments by at least one of a pocket formed in conjunction with one of the side and end panels and a partition extending generally vertical with respect to the base.

The above objects and advantages are also realized according to the present invention by a canopy for a bassinet, the bassinet being removably supported on an upper frame assembly of a folding play yard and having, the bassinet having a frame assembly including outer ends that are adapted to overly the upper frame assembly and be suspended therefrom. The canopy comprises a flexible panel including a buttonhole adjacent to each of two opposite edges of the flexible panel, each buttonhole being adapted to slide over a respective outer end of the bassinet; and a fastener provided adjacent to each of the opposite edges and adapted to cooperatively engage a mating fastener on either side of an exterior of the bassinet. Wherein the flexible panel extends across at least a portion of the bassinet frame assembly and is retained thereon by the buttonholes and the snap fasteners.

These objects and advantages, as well as other objects and advantages, of the present invention will be set forth in the description that follows, and in part will be readily apparent to those skilled in the art from the description and drawings, or may be learned by practice of the invention. The objects and advantages of the present invention may be realized and obtained by means of the instrumentalities and combinations particularly pointed out in the appended claims.

BRIEF DESCRIPTION OF THE DRAWINGS

The accompanying drawings show illustrative embodiments of the invention.

DETAILED DESCRIPTION OF THE PREFERRED EMBODIMENT

The invention generally pertains to a play yard apparatus that it is easily converted to use as a baby bassinet. According to a preferred embodiment of the present invention, an attachable storage unit provides an efficient use of space in connection with the play yard apparatus configured with the baby bassinet.

Figure 1:
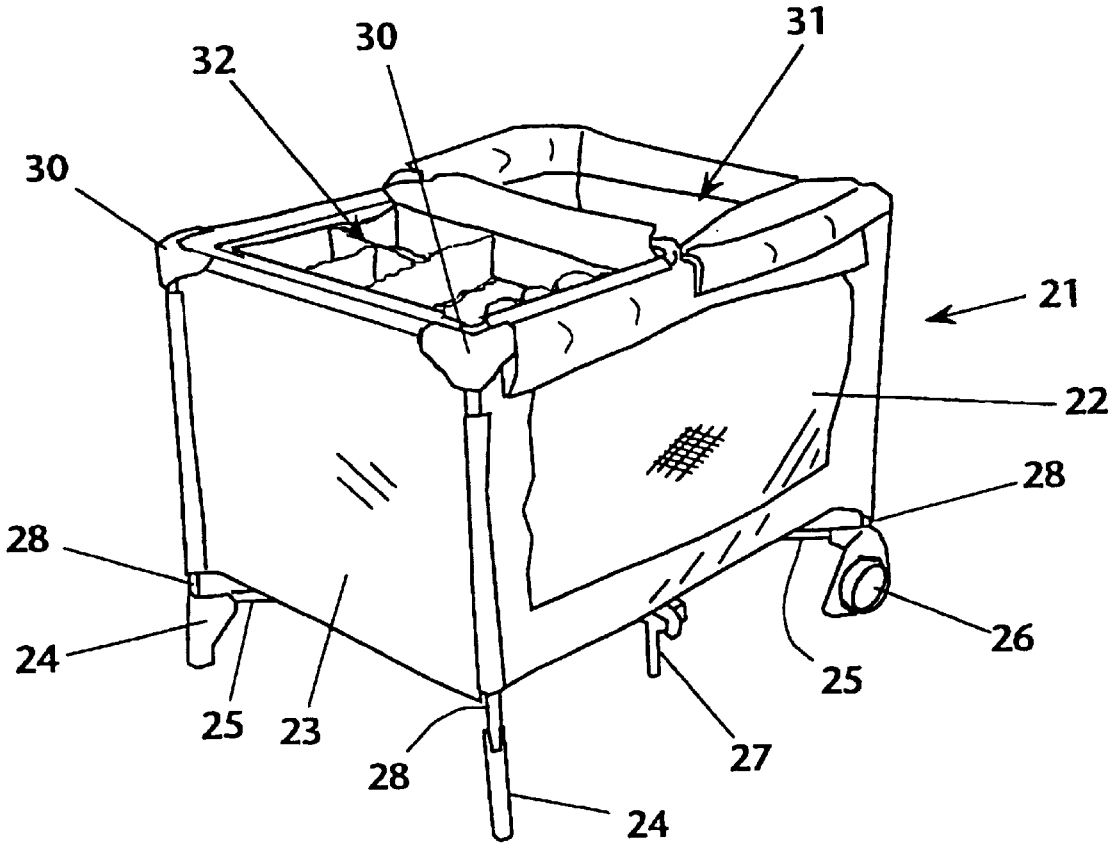
FIG. 1 is a perspective view of a play yard converted to a bassinet arrangement and a storage unit in accordance with the present invention.

With regard to FIG. 1, a typical foldable, portable play yard 21 includes a pair of fabric and mesh side panels 22 joined to a pair of fabric (or mesh) end panels 23 to form a rectangular enclosure. A floor panel (not shown) spans the lower edges of the side and end panels, and is supported by a lower frame structure. The lower frame structure may include legs 24 or wheels 26 joined to lateral struts 25. A quartet of vertical struts 28 extend upwardly through panel sleeves from the lower frame structure at the corners of the apparatus, and are joined to a quartet of upper corner brackets 30. An upper frame assembly comprises two pairs of parallel foldable rail assemblies which are interconnected by the upper corner brackets 30. The rail assemblies support the side and end panels 22,23 of the play yard 21. This generically described play yard defines a coffer-like configuration having an upper opening.

The present invention provides a storage unit assembly 32 that may be supported adjacent to a bassinet assembly 31 on the upper frame assembly of the play yard 21 and may be disposed so as to span the upper opening thereof. Both assemblies 31 and 32 are independent units that are easily installed and removed from the play pen, whereby the combined structures may be adapted for baby naps and baby changing and dressing functions. Thus, the combined structures comprise a complete infant care center that is optimally efficient in use of space, apparatus, and resources.

Figure 2:
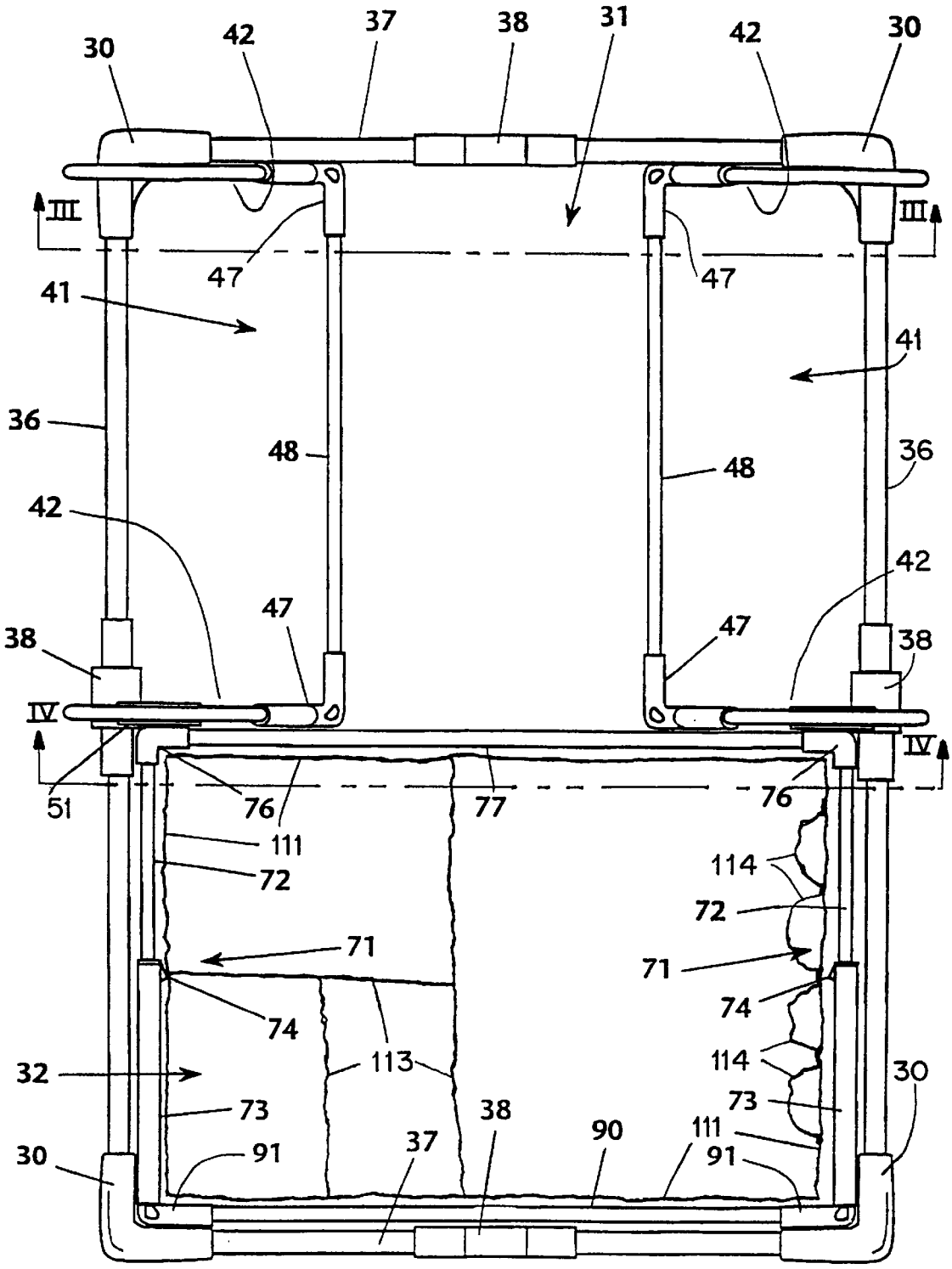
FIG. 2 is a plan view of the upper frame assembly of the play yard, together with the bassinet frame assembly and the storage unit shown in FIG. 1.
Figure 3:
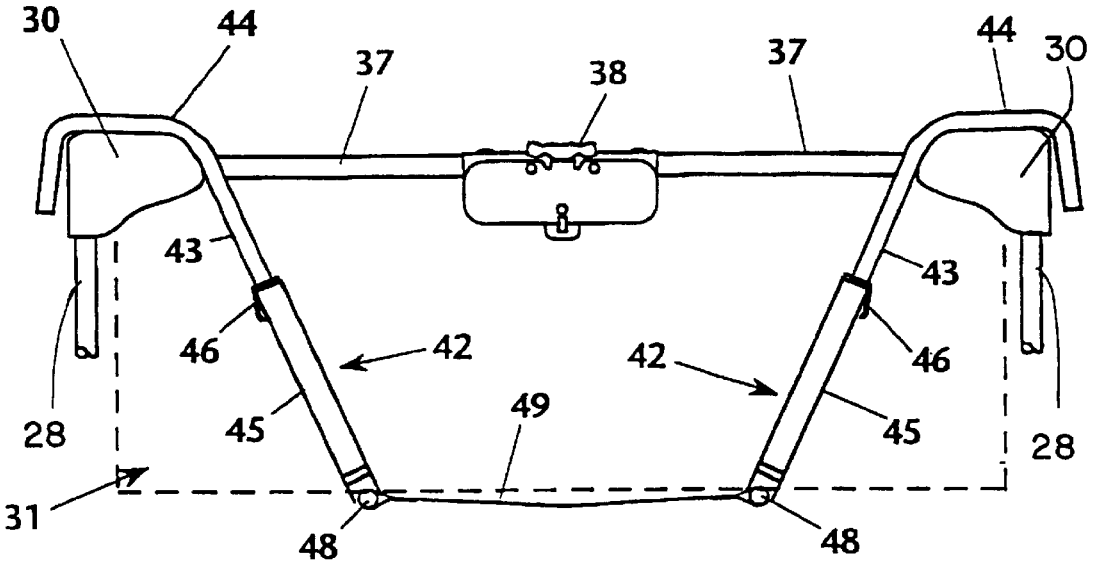
FIG. 3 is a partial end elevation taken along line III—III in FIG. 2 showing the engagement of the bassinet frame assembly with the corner brackets of the upper frame assembly of the play yard.

With regard to FIG. 2, the upper frame assembly of the play yard 21 generally includes the upper corner brackets 30 which join upper frame side rail assemblies 36 with upper frame end rail assemblies 37. The assemblies 36 and 37 are each provided with hinges 38 at mid-span that are selectively locked or pivotal to allow the upper frame assembly to be rigid or folded. With additional reference to FIGS. 3 and 4, the bassinet assembly 31 includes a pair of bassinet frame assemblies 41. Each assembly 41 includes a pair of J-tube assemblies 42, consisting of a J-tube 43 having an upper hook end 44 and a linear tubular portion depending therefrom and received in telescoping fashion in a bushing 45. A spring detent assembly 46 secured to the bushing 45 permits length adjustment and relative rotation of the telescoping engagement of the J-tube 43 and bushing 45.

An elbow 47 is secured to the lower end of each bushing 45, and oriented to secure a cross-tube 48 in a horizontal disposition between each pair of assemblies 42. Sleeves sewn on the bassinet sides and floor join the pair of bassinet frame assemblies 41. With the upper hook ends 44 hanging on the upper frame rail assemblies 36, the assemblies 42 extend down through the upper opening of the play yard 21. The cross-tubes 48, the sewn sleeves on the bassinet sides and the sewn sides and floor of the bassinet form a stable horizontal base for the floor of the bassinet, and side panels and end panels of soft fabric extend upwardly from the bassinet floor panel to form a coffer-like enclosure that is sufficiently small and cozy for the resting and napping functions of a bassinet.

One J-tube assembly 42 of each frame assembly 41 is disposed adjacent to a respective upper corner bracket 30, and the J-hook portion 44 thereof rests thereon in a supported relationship. The other end of the J-tube assembly 42 is disposed so that the J-hook end 44 thereof passes over the hinge 38 of the upper rail assembly 36, and is supported thereby. Thus the bassinet assembly 31 is supported entirely by suspension from the upper frame portion of the play yard 21, and may be installed and removed as a single unit. The bassinet assembly 31 is also readily disassembled and folded for easy transport.

Figure 8:
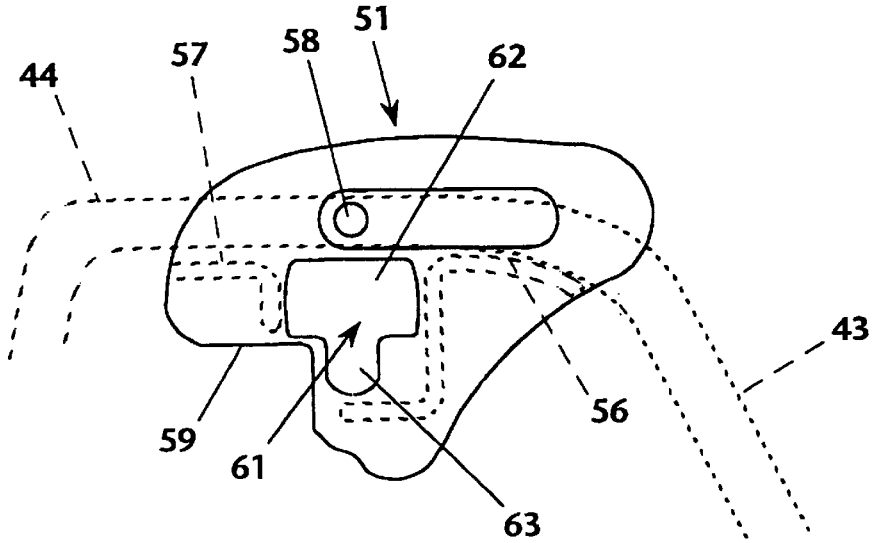
FIG. 8 is a side elevation of a hub adapter assembly constructed in accordance with the present invention.
Figure 9:
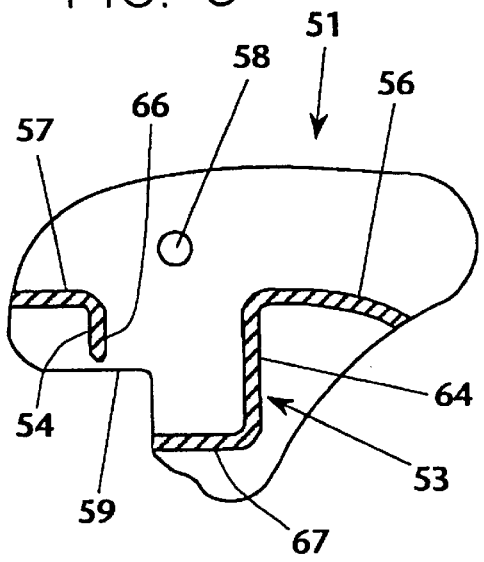
FIG. 9 is a cross-section elevation of the hub adapter shown in FIG. 8.
Figure 10:
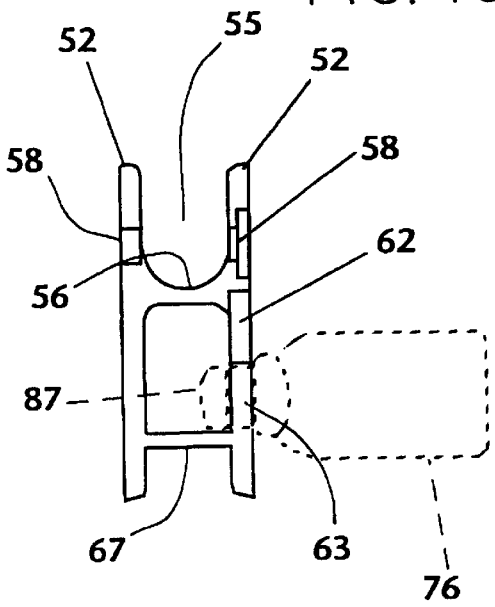
FIG. 10 is an end elevation of the hub adapter shown in FIGS. 8 and 9.

The present invention provides an adapter 51 that functions in part to secure the J-hook portion 44 to the hinge 38. With reference to FIGS. 8–10, the adapter 51 includes a pair of side-walls 52 disposed in parallel, spaced apart fashion, and transverse web portions 53 and 54 extending between the side-walls. The sidewalls 52 define therebetween a channel 55 having a width dimension sufficient to receive the J-hook end 44 therein in a minimal clearance fit. Upper portions 56 of web 53 and upper portion 57 of web 54 form the floor of the channel 55 upon which the J-hook end 44 may be supported. Aligned holes 58 extend through the sidewalls to receive a fastener such as a screw and nut assembly (not shown) that anchors the adapter 51 to the J-hook end 44. The outer perimetrical surface of the sidewalls is generally smoothly curved in convex fashion, except for a lower rectangular inset portion 59 that is configured to rest on the hinge 38 in a stable engagement.

Each adapter 51 further includes a keyhole 61 extending into one sidewall 52. The keyhole 61 includes a wide, generally rectangular upper portion 62 and a narrow slot portion 63 centered at the lower edge of the upper portion. The keyhole 61 is spaced laterally between the web portions 64 and 66 and vertically above the web portion 67. The purpose of the keyhole is clarified in the following description.

Figure 4:
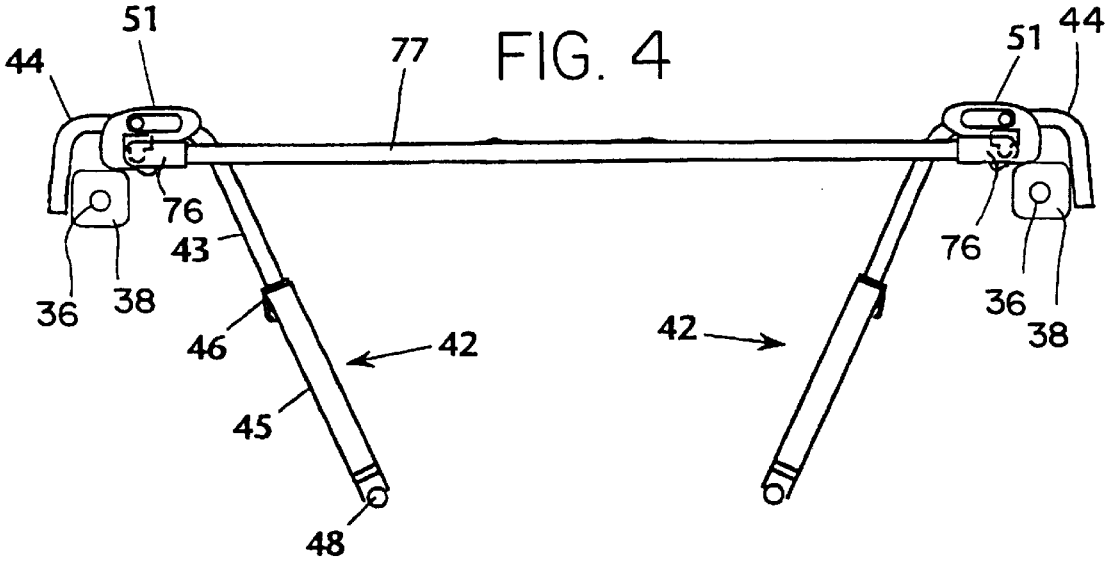
FIG. 4 is a partial end elevation taken along line IV—IV in FIG. 2 showing the engagement between the storage unit frame assembly and the bassinet frame assembly.
Figure 5:
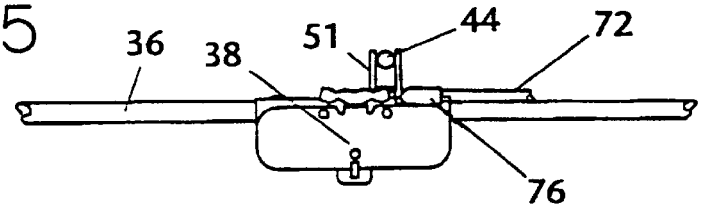
FIG. 5 is a partial side elevation depicting the engagement of the hub adapter and a portion of the storage unit frame assembly with the upper frame assembly of the play yard.

With reference to FIGS. 2 and 4, the storage unit assembly 32 includes a tubular rectangular frame that supports a generally horizontal base below the upper frame assembly of the play yard. The rectangular frame includes a pair of extendable assemblies 71, comprised of a tube 72 received in telescoping fashion in a larger tube 73. A spring detent assembly 74 permits selective length adjustment of the assembly 71. The outer end of each tube 72 is joined to a keyed elbow connector 76, and a lateral tube 77 is joined to the keyed elbow connectors 76 to span the sides of the play yard 21.

Figure 11:
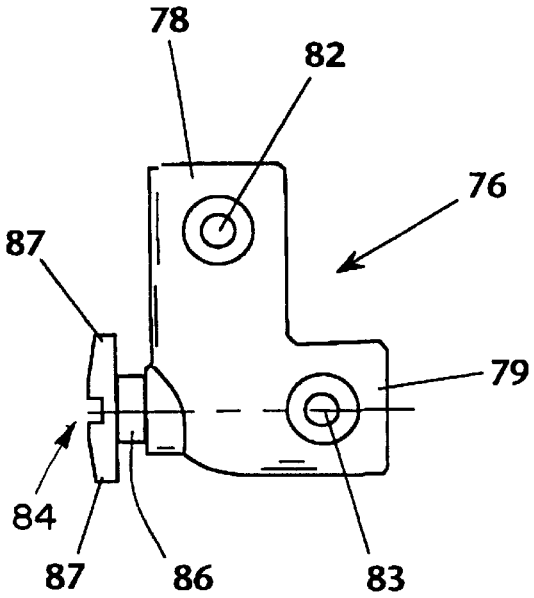
FIG. 11 is a plan view of the first elbow connector of the storage unit frame assembly of the invention.
Figure 12:
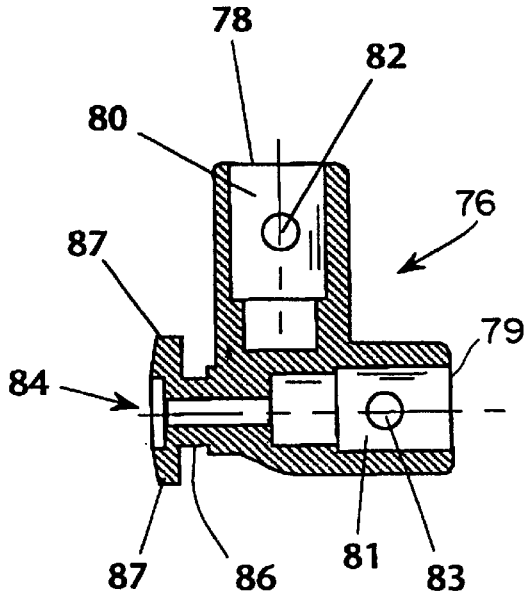
FIG. 12 is a cross-sectional plan view of the first elbow connector as shown in FIG. 11.
Figure 13:
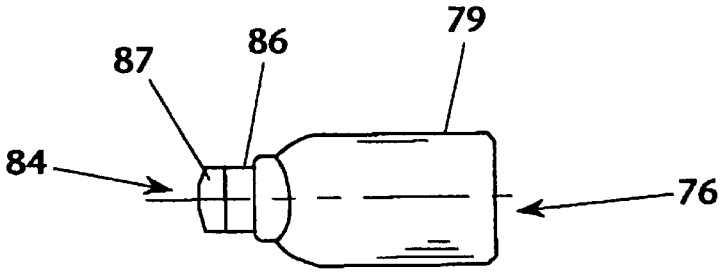
FIG. 13 is an end view of the first elbow connector shown in FIGS. 11 and 12.
Figure 14:
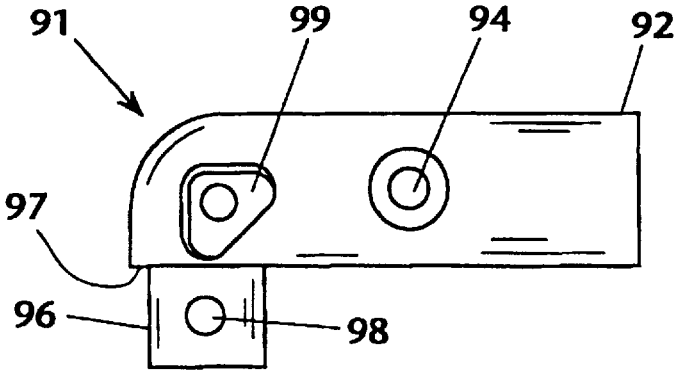
FIG. 14 is a plan view of the second elbow connector of the storage unit frame assembly of the invention.
Figure 15:
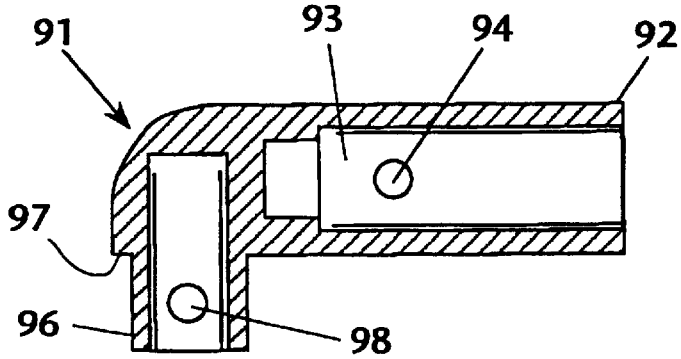
FIG. 15 is a cross-sectional plan view of the second elbow connector shown in FIG. 14.
Figure 17:
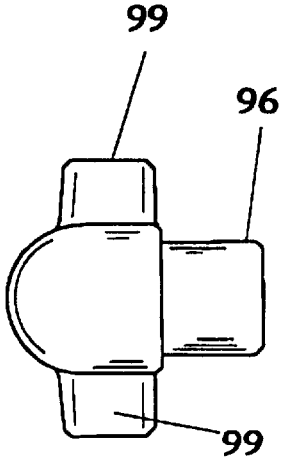
FIG. 17 is an end view of the second elbow connector shown in FIGS. 14–16.
Figure 16:
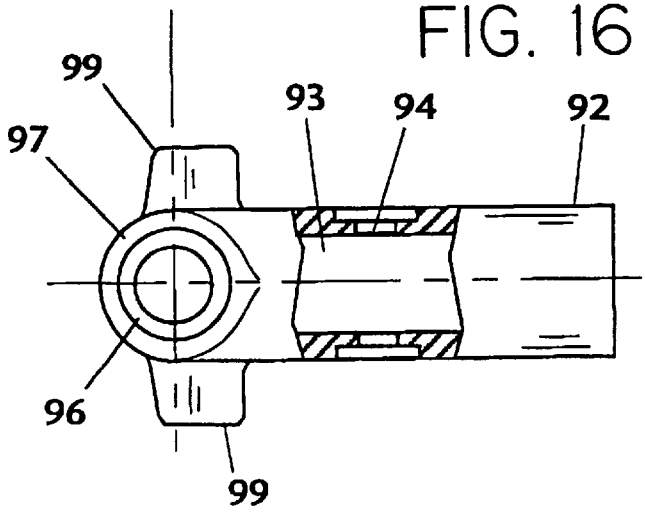
FIG. 16 is a partially broken away side elevation of the second elbow connector shown in FIGS. 14 and 15.
Figure 18:
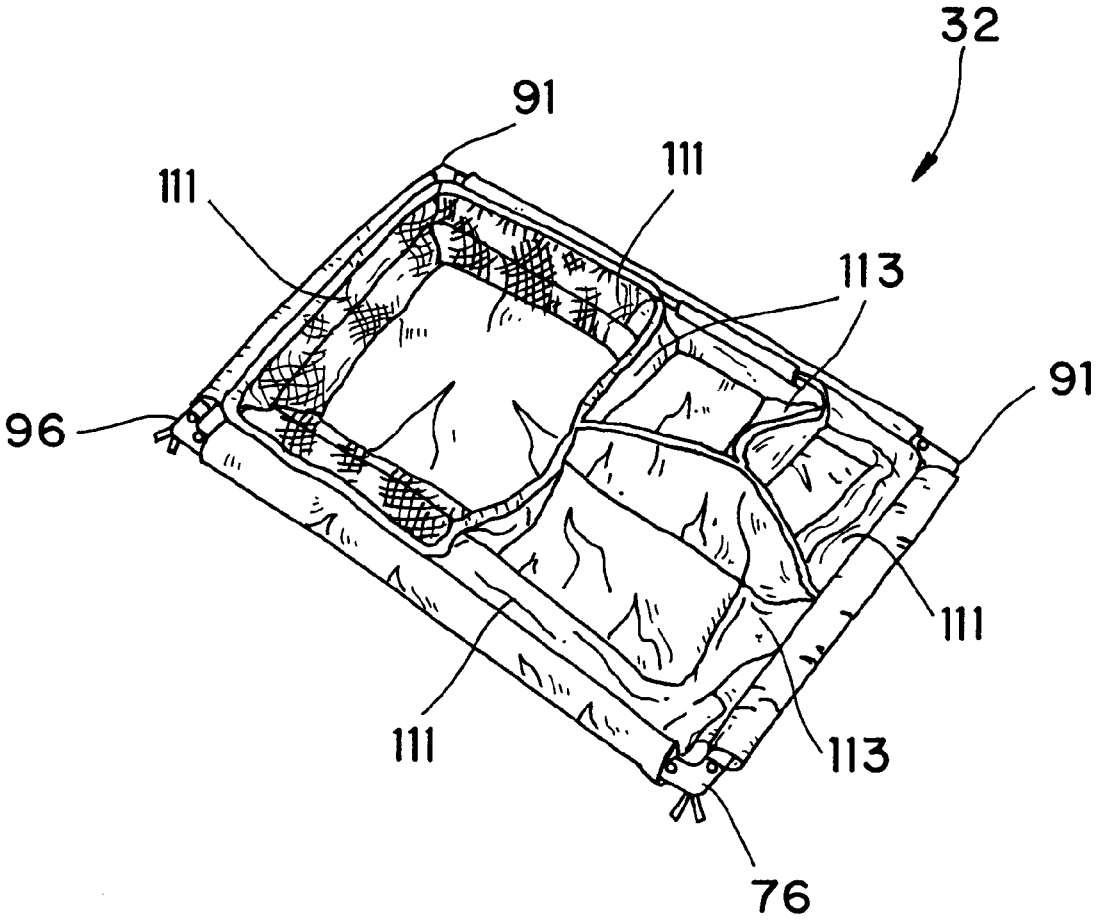
FIG. 18 is a perspective view of the storage unit shown in a folded condition and separated from the play yard.
Figure 19:
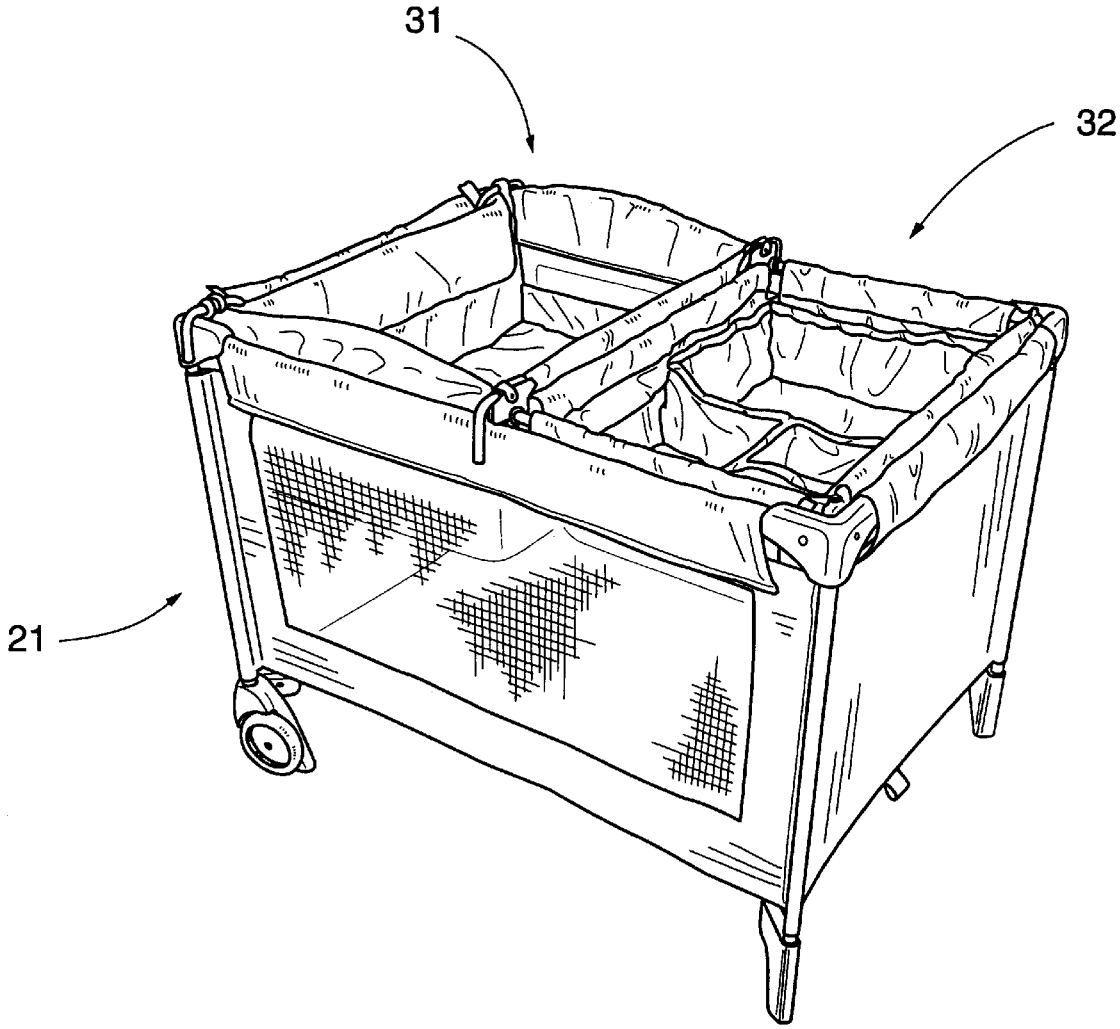
FIG. 19 is a perspective view of the storage unit shown in an installed condition with respect to the play yard.
Figure 20:
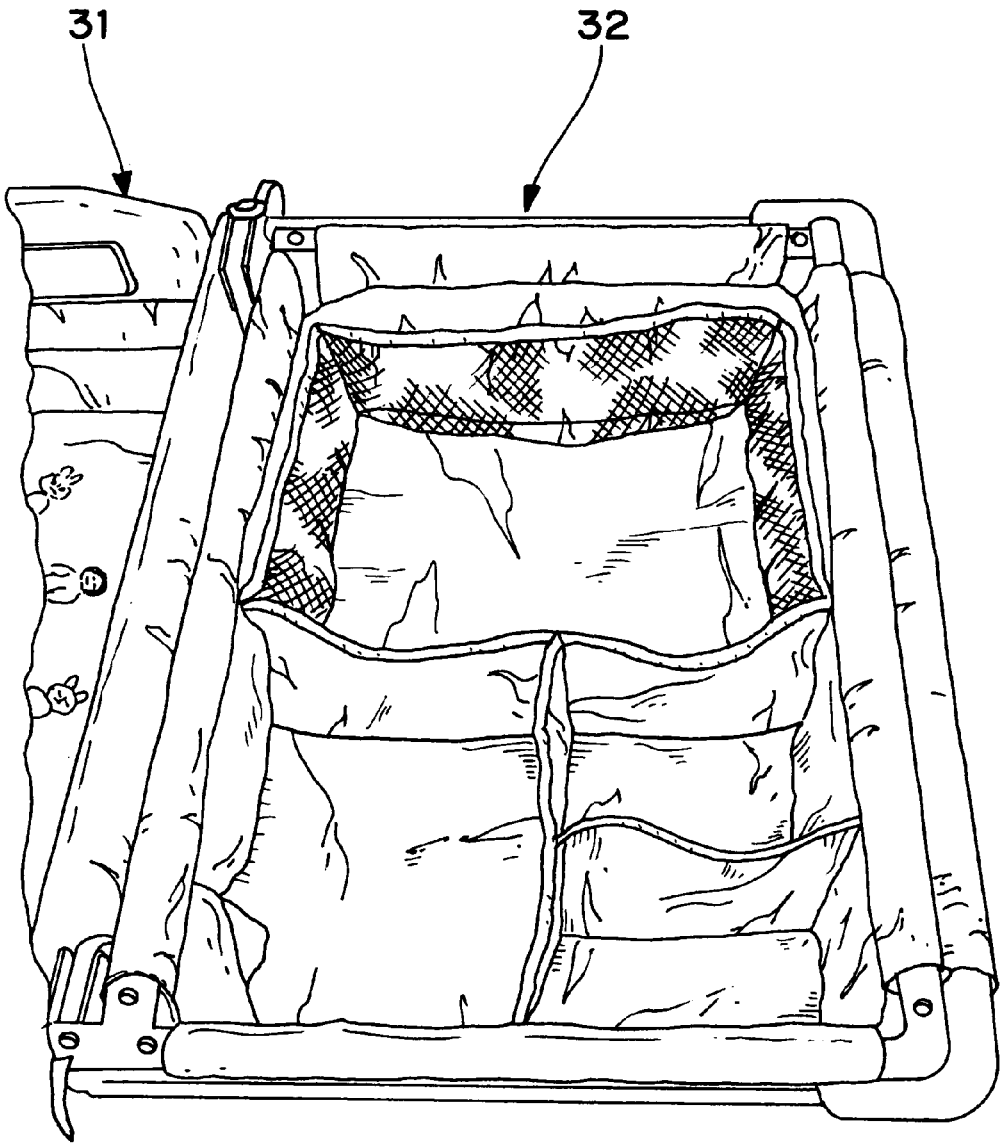
FIG. 20 is a detail view of the storage unit shown in FIG. 19, in an empty condition.
Figure 21:
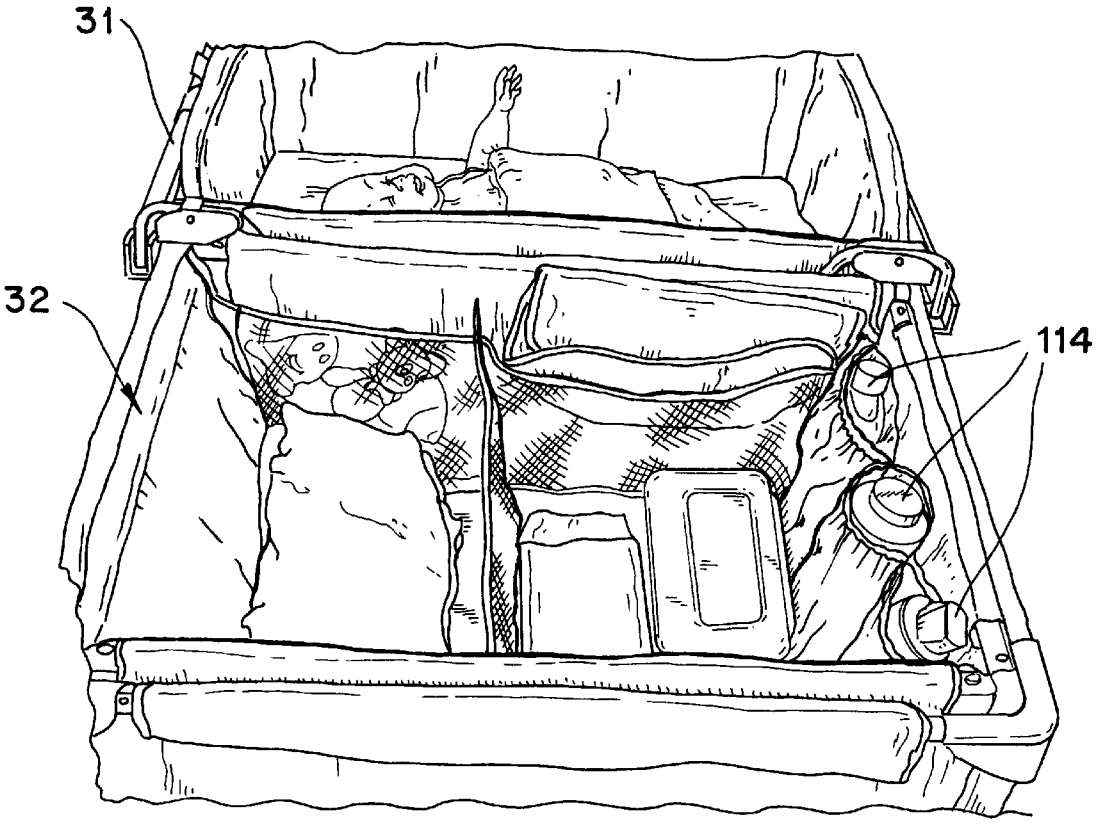
FIG. 21 is a detail view of the storage unit shown in FIG. 19, in a loaded condition.

With reference to FIGS. 11–13, each keyed elbow connector 76 is comprised of tubular body portions 78 and 79 joined in orthogonal relationship. Cylindrical receptacles 80 and 81 are formed concentrically in respective body portions 78 and 79. Receptacle 80 is dimensioned to receive therein lateral tube 77, and receptacle 81 is dimensioned to receive telescoping tube 72. Screw holes 82 and 83 accommodate fasteners to retain the tubes in their respective receptacles. A T-shaped key 84 extends from the elbow; the key 84 including a narrow stem 86 extending generally coaxially with the receptacle 81. Outer flanges 87 extend from the stem 86 and are aligned generally parallel to the axis of receptacle 80.

The flanges 87 are slightly narrower than the width of portion 62 of keyhole 61 (FIG. 8), so that the flanges 87 may be inserted into the portion 62. The width of slot 63 of the keyhole is greater than the diameter of stem 86 of the key 84, but the slot 63 is significantly narrower than the width of the flanges 87. As a result of these dimensional relationships, the key 84 may be inserted into opening 62 and the stem may be urged into slot 63, whereby the key 84 is lodged in the keyhole 61 (FIG. 10). This releasable engagement serves to support the elbow connectors 76 on the hub adapters 51, and thus to support two corners of the tubular rectangular frame of the storage unit assembly.

Returning to FIG. 2, each tube 73 is joined to an elbow connector 91, and a lateral tube 90 is joined to the keyed elbow connectors 91 to span the sides of the play yard 21. With reference to FIGS. 14–17, each elbow connector 91 includes a tubular body 92 having a coaxial receptacle 93 formed therein and dimensioned to accept the lateral tube 90. Aligned screw holes 94 are disposed to receive appropriate fasteners to retain the tube 90 in a receptacle 93. A cylindrical anchor 96 extends from one end of the body 92, and is disposed concentrically within an annular flat 97. The anchor 96 has an outer diameter dimensioned to be received within tube 73, and a screw hole 98 accepts a fastener to secure the tube 73 about the anchor 96.

A salient feature of the elbow connector 91 is the provision of a pair of posts 99 extending therefrom in opposed relationship. The posts 99 are aligned along an axis extending orthogonally to both the axis of the tubular body 92 and the axis of the cylindrical anchor 96. As shown best in FIG. 14, each post 99 is configured as a triangular prism, for purposes detailed in the following description. The posts 99 are disposed at the end of the tubular body 92 and are generally adjacent to the anchor 96.

Figure 6:
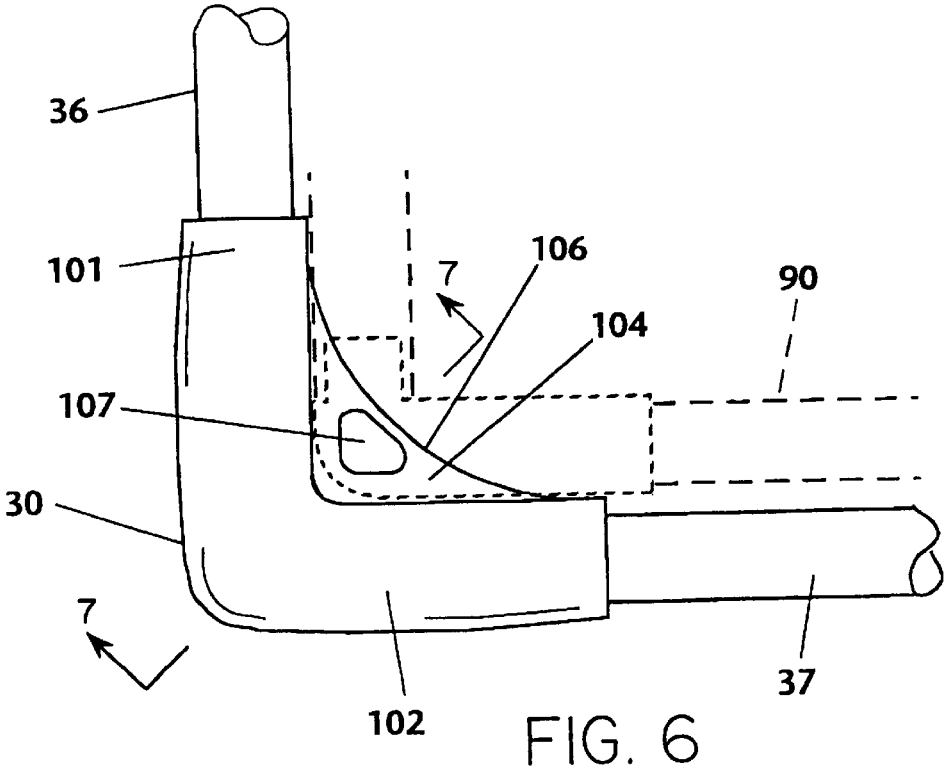
FIG. 6 is an enlarged plan view of the upper corner bracket assembly of the play yard, and the relationship of the storage unit frame assembly (shown in broken lines) with respect to the upper corner bracket.
Figure 7:
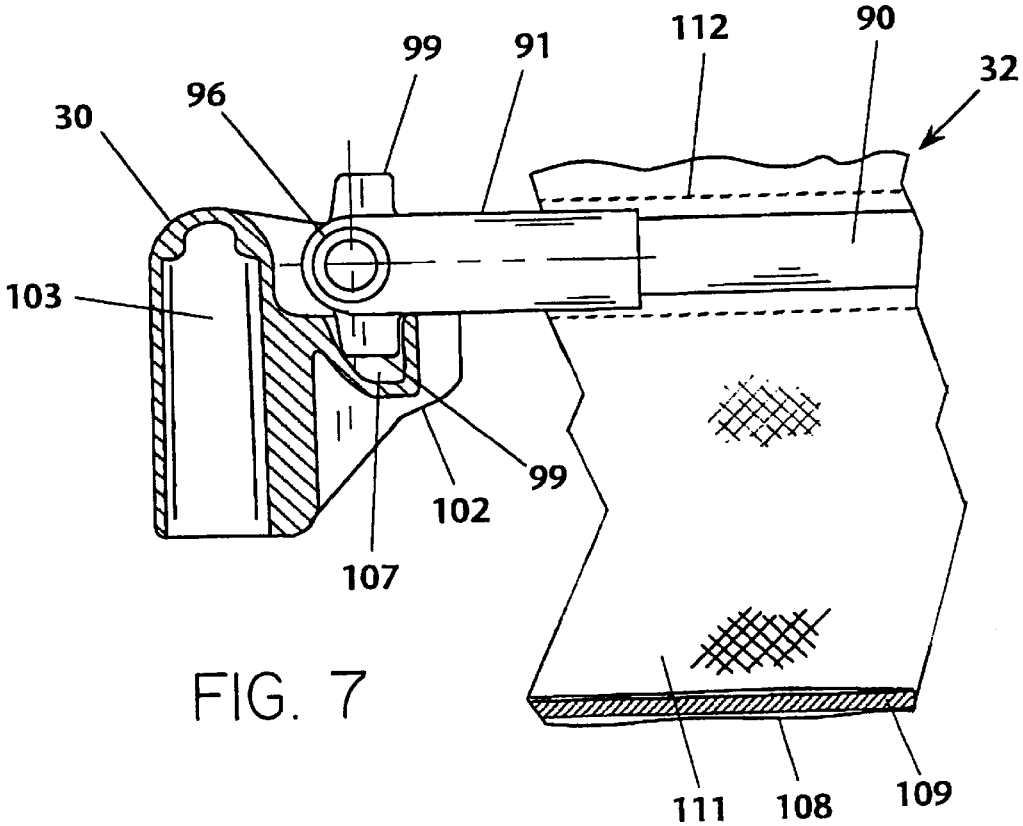
FIG. 7 is a cross-sectional elevation taken along line VII—VII of FIG. 6 showing the relationship of the storage unit frame assembly and the upper corner bracket assembly.

With reference to FIGS. 6 and 7, each upper corner bracket 30 of the play yard 21 includes body portions 101 and 102 diverging from a common vertex in orthogonal relationship. Each body portion 101 and 102 includes sockets (not shown) for receiving and securing converging ends of the upper rail assemblies 36 and 37. In addition, a vertical receptacle 103 is provided to secure the upper end of a respective vertical strut 28.

A salient feature of the upper corner bracket 30 is the provision of a web 104 extending horizontally between the body portions 101 ad 102 and disposed in the included angle therebetween. The web 104 includes a smoothly curved interior edge 106. A concave pocket 107 is formed in a medial portion of the web 104. The pocket is provided with a triangular configuration and is dimensioned to receive one of the triangular posts 99 of one of the elbow connectors 91. The connector 91 is adapted to rest on the web 104 in supported relationship, and the engagement of the post 99 in the pocket 107 firmly secures the elbow connector 91 with respect to the corner of the play yard 21. Thus the two corners of the storage unit assembly 32 that are adjacent to two corners of the play yard are supported vertically and stabilized horizontally.

The storage unit assembly 32 in FIG. 7 may be provided with a floor assembly 108 that includes a stiffening panel 109 secured within a fabric enclosure that is formed of waterproof or stain-resistant material, as is known in the prior art. Fabric panels 111 extend upwardly a short distance, and are provided with sewn sleeves 112 that extend about the lateral tubes 77 and 90, as well as about the assemblies 71. The panels 111 thus support the floor assembly 108 below the upper extent of the play yard 21, whereby the storage unit floor 108 is disposed at a height convenient for supplies and items associated with caring for a baby or infant.

According to a preferred embodiment of the invention, one or more partitions 113 or pockets 114 divide the storage unit assembly 32 into separate compartments. According to a most preferred embodiment of the invention illustrated in FIGS. 2 and 18–21, three partitions 113 extend generally vertically with respect to the floor assembly 108 and extend horizontally from panels 111 or from one another. Similarly, four pockets 114 are formed in conjunction with a panel 111. The partitions 113 and pockets 114 may be formed from the same or a different material as panels 111. For example, the panels 111, partitions 113, and pockets 114 may be formed from a tightly woven fabric, an elastic band, or a mesh material. Similarly, the panels 111, partitions 113, or the pockets 114 may be reinforced with rigid or semi-rigid stiffening panels. Of course, different permutations in the numbers, configurations, sizes, and materials of the partitions 113 and pockets 114 are envisioned within the scope of the present invention. The compartments formed by the panels 111, partitions 113, and pockets 114 serve to organize and make readily accessible supplies and childcare items such as diapers, wipes, clothes, linens, toys, ointments, food, bottles, or accessories for the bassinet such as the canopy according to the second aspect of the invention described hereinafter.

In the interests of manufacturing efficiency and simplicity in deployment of the apparatus, all of the upper corner brackets may be fashioned as depicted in FIG. 6, even though the storage unit assembly engages only two of the upper corner brackets at any one time. Likewise, the elbow connectors 47 of the bassinet assembly may be made identical to the elbow connectors 91 of the storage unit assembly.

The side-by-side relationship of the bassinet assembly 31 and the storage unit assembly 32 makes the supplies and other childcare items that are often used before and after naps, directly adjacent and readily available to the napping location. The bassinet is self-supporting atop the play yard structure, whereby it is easily installed or removed as needed. Likewise, the storage unit assembly is easily installed or removed on demand, and is cooperatively supported by the play yard structure and the adjacent bassinet assembly.

According to the second aspect of the present invention show in FIGS. 22–25, a canopy 120 may be fitted to the bassinet 31 to at least partially shield a baby in the bassinet from the environment in which the play yard 21 is placed. The canopy 120 includes a flexible panel 122 such as a tightly woven fabric, an open mesh fabric, mosquito netting, etc. At least one rib 124 is sized so as to extend between the sides of the bassinet 31 and to provide support for the flexible panel 122 so that it does not sag into the bassinet 31. According to the preferred embodiments of the invention show in FIGS. 22–24, a plurality of ribs 124 extend within sleeves formed by the flexible panel 122 and cause the flexible panel 122 to assume a convex configuration above an end of the bassinet 31.

Figure 22:
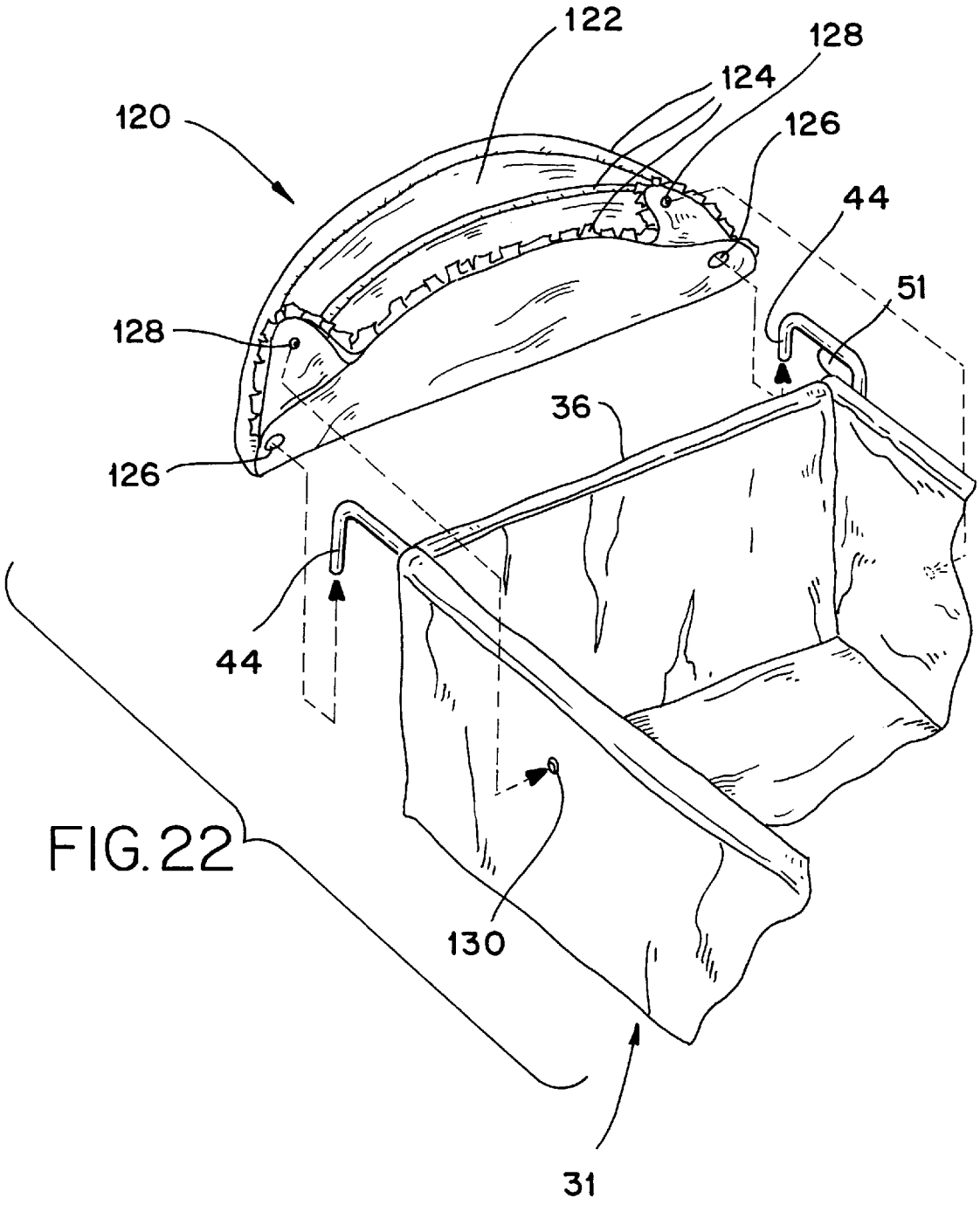
FIG. 22 is an exploded perspective view showing a portion of the bassinet receiving a canopy according to the present invention.
Figure 23:
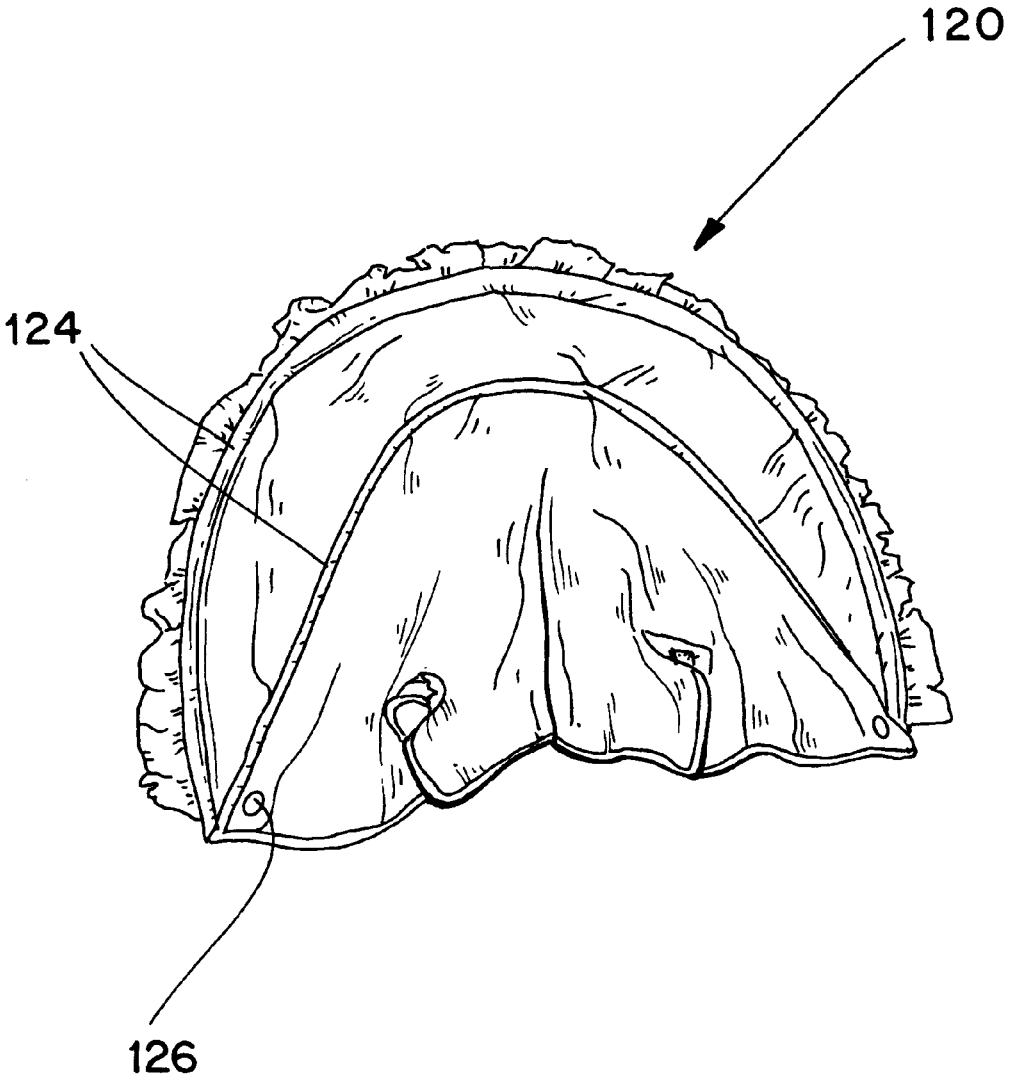
FIG. 23 is a perspective view of the canopy shown in a folded condition and separated from the bassinet.

The flexible panel 122 is detachably retained with respect to the bassinet by a fastening system including button holes 126 that slide over the ends of J-hook ends 44, and fasteners 128 on the canopy 120 cooperatively engaging corresponding fasteners 130 on the bassinet 31 (only one fastener 130 is shown in FIG. 22). The fasteners 128 and 130 may include snaps, buttons and holes, hook and loop patches, e.g., VELCRO®, or another releasable fastening system.

Figure 24:
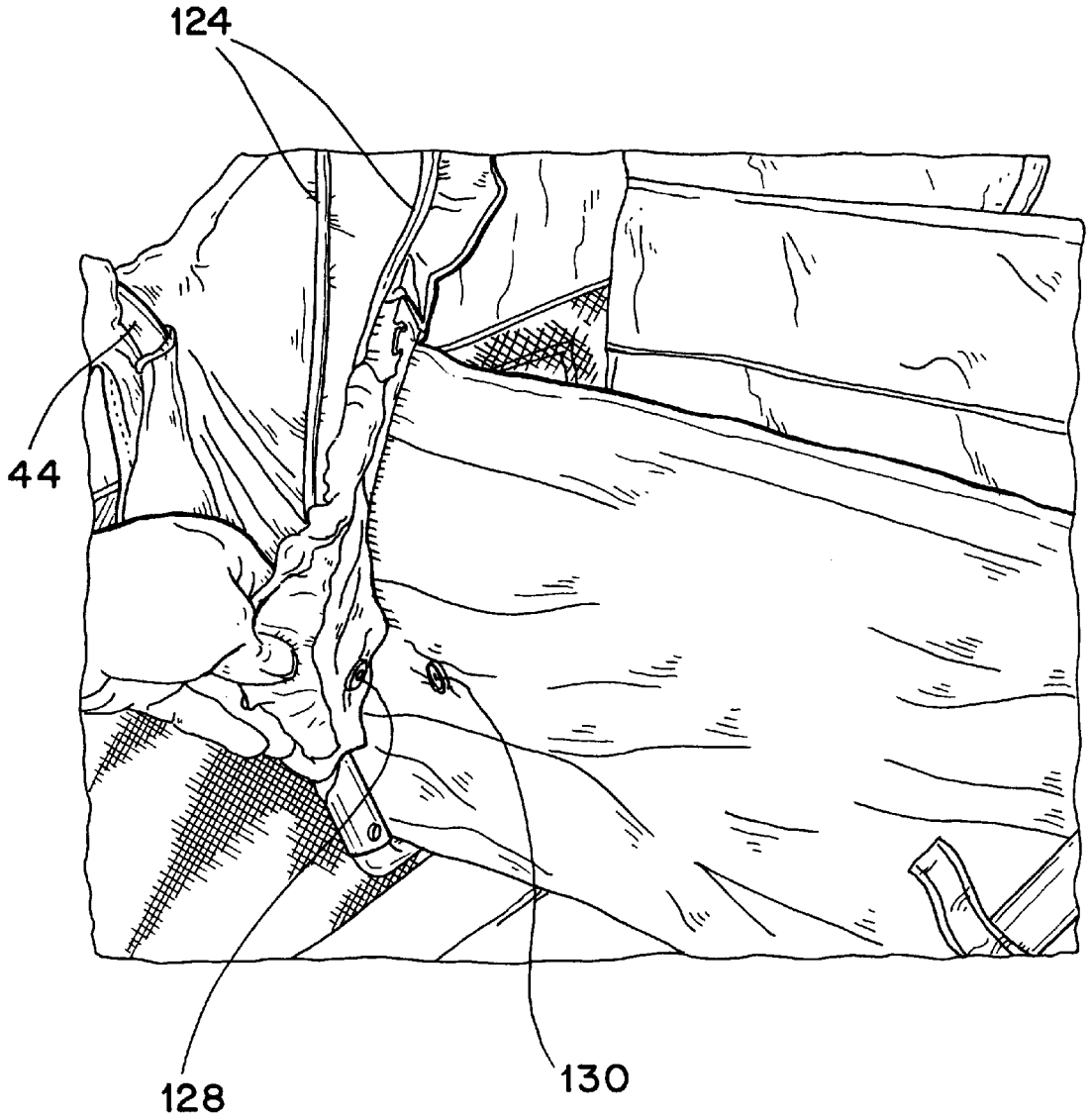
FIG. 24 is a perspective view illustrating how the canopy is attached to the bassinet.
Figure 25:
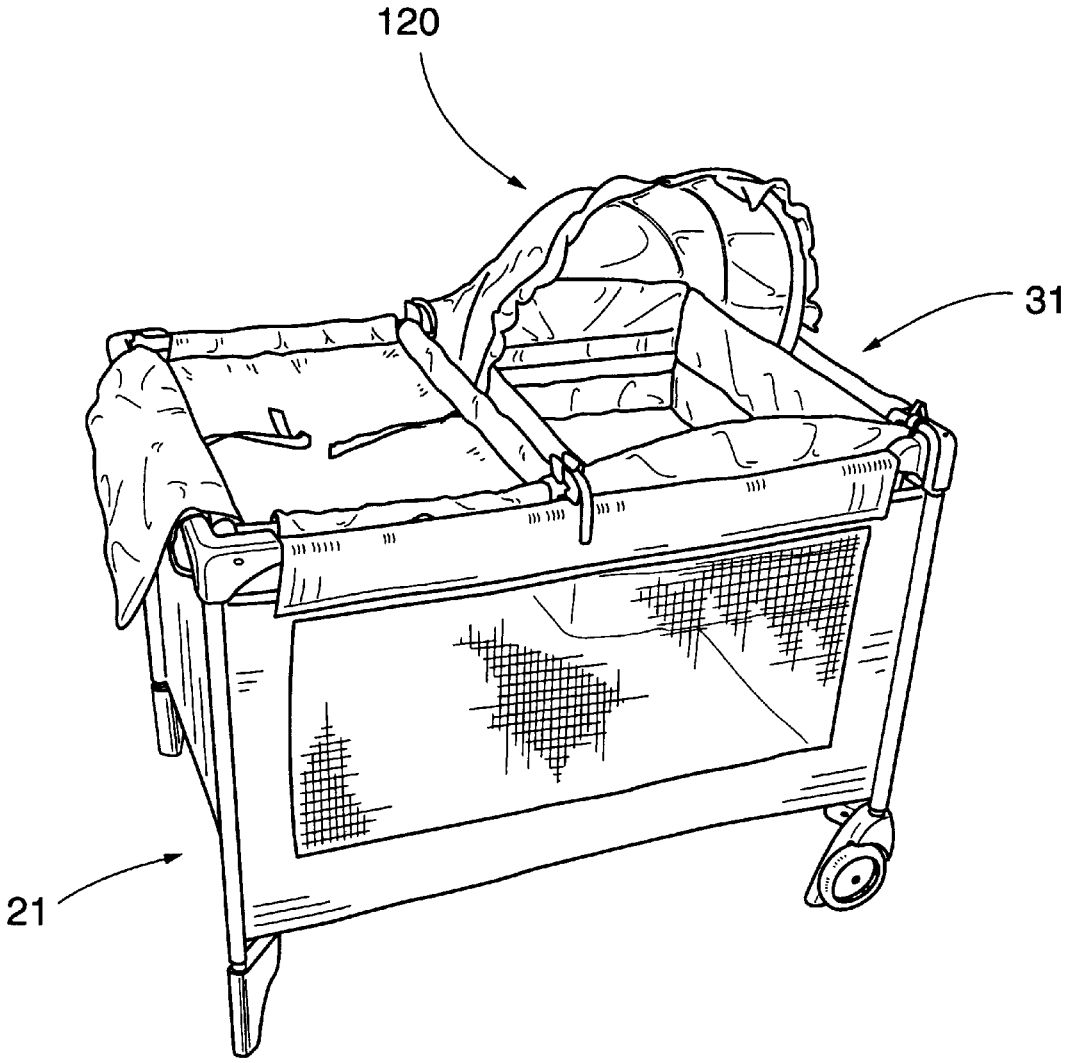
FIG. 25 is a perspective view showing the canopy attached to the bassinet.

As shown in FIGS. 22 and 24, the canopy 120 is installed on the bassinet by initially sliding the button holes 126 over a pair of J-hooks 44, and then cooperatively engaging the fasteners 128 and 130 to retain the front edge of the canopy 120 with respect to the bassinet 31. In the course of installing the canopy 120, the ribs 124 are positioned in a convex arrangement and may be adjustably positioned after the fastening system is completed.

Although the canopy according to the present invention has been illustrated in conjunction with a play yard that is convertible to a bassinet, the fastening system may also be used with other types of bassinets, prams strollers or like that have projections to receive the button holes 126 and fasteners 130 corresponding to the fasteners 128. Of course, many permutations on the design are possible using different materials, different decorative trims, different numbers or shapes of ribs, etc.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated.

What is claimed is:

1. A storage unit for a folding play yard, the folding play yard having an upper frame assembly including two pairs of parallel foldable rail assemblies connected by upper corner brackets and a bassinet assembly being removably supported in a first portion of the upper frame assembly, the storage unit comprising:

a tubular frame having first and second side tubes and a pair of end tubes joined in a rectangular configuration, the tubular frame being adapted to be supported in a second portion of the upper frame assembly adjacent to the bassinet assembly; and a generally horizontal base joined to side panels and to end panels, each of the panels being provided with sleeves to engage a respective one of the tubes of the tubular frame so as to support the base in a suspended relationship;

wherein a space defined within the horizontal base, side panels, and end panels is divided into at least two compartments by at least one of a pocket formed in conjunction with one of the side and end panels and a partition extending generally vertical with respect to the base.

2. The storage unit according to claim 1, further comprising:

a pair of first elbow connectors, each of the first elbow connectors being disposed at a respective vertex of the tubular frame and joining the first side tube and a respective end tube in an orthogonal relationship, and each of the first elbow connectors being adapted to be supported by the bassinet assembly; and a pair of second elbow connectors, each of the second elbow connectors being disposed at a respective vertex of the tubular frame and joining the second side tube and a respective end tube in an orthogonal relationship, and each of the second elbow connectors being adapted to be supported by the upper frame assembly.

3. The storage unit according to claim 1, further comprising:

a plurality of partitions dividing the space into at least three compartments.

4. The storage unit according to claim 1, further comprising:

a combination of at least one partition and at least one pocket dividing the space into at least three compartments.

5. The storage unit according to claim 1, wherein at least one of the base, side panels, and end panels includes a close woven fabric stiffened with a rigid panel.

6. The storage unit according to claim 1, wherein at least one of the base, side panels, and end panels includes a mesh fabric.

7. The storage unit according to claim 1, wherein the at least one pocket includes a mesh fabric, and a mouth of the at least one pocket is includes an elastic strap.

8. The storage unit according to claim 1, wherein the at least one partition includes a close woven fabric stiffened with a rigid panel.

9. The storage unit according to claim 1, wherein the at least one partition includes a mesh fabric.

10. A canopy for a bassinet, the bassinet being removably supported on an upper frame assembly of a folding play yard and having, the bassinet having a frame assembly including outer ends that are adapted to overly the upper frame assembly and be suspended therefrom, the canopy comprising:

a flexible panel including a buttonhole adjacent to each of two opposite edges of the flexible panel, each buttonhole being adapted to slide over a respective outer end of the bassinet; and a fastener provided adjacent to each of the opposite edges and adapted to cooperatively engage a mating fastener on either side of an exterior of the bassinet;

wherein the flexible panel extends across at least a portion of the bassinet frame assembly and is retained thereon by the buttonholes and the snap fasteners.

11. The canopy according to claim 10, further comprising:

at least one rod attached to the fabric panel and adapted to extend between the exterior sides of the bassinet;

wherein the at least one rod is adapted to cause the fabric panel to assume a convex contour with respect to the upper frame assembly

12. The canopy according to claim 10, wherein the fasteners include a first one of male and female snaps.

13. The canopy according to claim 12, wherein the mating fasteners include a second one of the male and female snaps.

14. The canopy according to claim 10, wherein the fasteners include a first one of hook and loop patches.

15. The canopy according to claim 12, wherein the mating fasteners include a second one of the hook and loop patches.

16. The canopy according to claim 10, wherein the flexible panel includes at least one of a close woven fabric and a mesh fabric.

* * * * *